US005949196A

United States Patent [19]

Lesea et al.

[11] Patent Number: 5,949,196

[45] Date of Patent: Sep. 7, 1999

[54] METHOD AND SYSTEM FOR SWITCHABLE LIGHT LEVELS IN OPERATING GAS DISCHARGE LAMPS WITH AN INEXPENSIVE SINGLE BALLAST

[75] Inventors: Ronald A. Lesea, Redwood City; Bruce A. Pelton, El Sobrante, both of Calif.

[73] Assignee: Lumatech Corporation, Emeryville, Calif.

[21] Appl. No.: 08/816,838

[22] Filed: Mar. 13, 1997

[51] Int. Cl.[6] ..... H05B 37/00

[52] U.S. Cl. ..... 315/240; 315/241 R; 315/209 R; 315/DIG. 4

[58] Field of Search ..... 315/240, 246, 315/209 R, 291, 51, 58, 56, 86, 241 R, DIG. 4

[56] References Cited

U.S. PATENT DOCUMENTS

| | | | |
|---|---|---|---|
| 4,178,535 | 12/1979 | Miller | 315/53 |
| 4,237,403 | 12/1980 | Davis | 315/98 |
| 4,284,925 | 8/1981 | Bessone et al. | 315/240 |
| 4,414,489 | 11/1983 | Young | 315/51 |
| 5,084,653 | 1/1992 | Nilssen | 315/219 |
| 5,099,176 | 3/1992 | Fellows et al. | 315/86 |
| 5,245,253 | 9/1993 | Quazi | 315/224 |
| 5,315,214 | 5/1994 | Lesea | 315/209 R |
| 5,424,610 | 6/1995 | Pelton | 315/58 |
| 5,457,360 | 10/1995 | Notohamiprodjo et al. | 315/219 |
| 5,491,385 | 2/1996 | Nilssen | 315/178 |

*Primary Examiner*—Haissa Philogene
*Attorney, Agent, or Firm*—Marger Johnson & McCollom P.C.

[57] ABSTRACT

An arrangement for switchably operating one or more gas discharge lamps, such a compact or circline fluorescent lamps, with a single ballast commonly used with a linear fluorescent lamp. One or more capacitors is either in parallel or in series with the gas discharge lamp. When engaged by a switch, the capacitor either shunts or reduces the current to the gas discharge lamp in a manner which allows appropriate starting voltage, appropriate operating current and a plurality of illumination levels of the gas discharge lamp.

27 Claims, 4 Drawing Sheets

METHOD AND SYSTEM FOR SWITCHABLE LIGHT LEVELS IN OPERATING GAS DISCHARGE LAMPS WITH AN INEXPENSIVE SINGLE BALLAST

FIELD OF THE INVENTION

This invention relates to a system and method for configuring a single, common inexpensive electronic or magnetic ballast typically designed for use with linear fluorescent lamps to operate in a manner which provides multi-way switching and dimmability for the operation of one or more fluorescent lamps.

BACKGROUND OF THE INVENTION

Fluorescent lamps of all types are now used in lieu of incandescent bulbs for several reasons. To begin with, the energy requirement to operate a fluorescent lamp is much less than the energy requirement to operate an incandescent or halogen lamp having the same lumen output. Additionally, the quality of the light output from fluorescent lamps has newly improved color spectral output, making their light more pleasing that it had been in the past. Moreover, fluorescent lamps are available in a wide variety of shapes and sizes and thus are better meeting size requirements. Examples of different types are linear fluorescent lamps, compact fluorescent lamps and circline (circular) fluorescent lamps. However, in the case of the use of compact fluorescent lamps, especially for 18 watt and higher powers, the required ballast's cost often deters lighting users from choosing compact fluorescent lighting instead of incandescent lighting, even though in the long run, their energy costs savings would more than make up the difference.

Ballasts are a necessary component of fluorescent lighting because fluorescent lamps require current limiting and a starting voltage higher than the typical household or industrial line voltage. Thus, a fluorescent lamp fixture always includes a ballast such as an iron core inductor or one consisting of electronic components. When connected between the power source and the lamp, a ballast provides limited current and a proper starting voltage. Each type and size of fluorescent lamp has a particular current requirement and therefore to accommodate the wide number of variations, different types of ballasts are manufactured. However, since certain linear fluorescent lamps are used much more pervasively than compact fluorescent lamps, ballasts for these linear fluorescent lamps are the most inexpensive type available.

Recently, particular types of lamp fixtures have been designed for halogen lighting, which is particularly bright. However, halogen lamps in certain fixtures have recently been shown to present a fire danger and therefore their use is discouraged or in some cases, restricted. In such fixtures, a single compact or circline fluorescent lamp might not meet the user's lumen output requirements, but two such compact or circline fluorescent lamps will. The problem remains to provide a ballasting method which fits halogen lamp fixtures to operate compact or circline fluorescent lamps and which is inexpensive enough to appeal to most consumers.

Typically, common (very inexpensive) T8 or T12 ballasts are used to operate two T8 or T12 four-foot linear fluorescent lamps. On the other hand, a compact fluorescent lamp of choice, such as an F36 lamp, requires the use of a ballast which is not produced in mass quantities and is therefore quite expensive. In this manner, the cost of ballasts for compact fluorescent lamps oftentimes inhibits their use by manufacturers for the mass consumer market.

While widely available, these inexpensive T8 or T12 two-lamp ballasts will not generally operate a single compact fluorescent bulb at the proper current, nor are they dimmable. Previously, there has been no utilization of a T8 or T12 ballast with a single F36 compact fluorescent lamp since that lamp does not have the same arc voltage and current ratings as two four-foot linear lamps for which common electronic ballasts were designed. However, it would be extremely desirable to be able to use a common T8 or T12 ballast (or comparable ballast) with a single F36 lamp (or comparable compact fluorescent lamp). Moreover, it would be also desirable to use a common T12 ballast with a plurality of F36 lamps with a multi-way switching capability, which in essence provides dimmability. That is, three-way switchability would include 0%, 50% and 100% illumination. A four-way switchability would include ⅓ illumination, ⅔ illumination and full light levels, as well as "off."

The most common inexpensive ballast type is the series-sequence, rapid-start, two-lamp type. This is true for both the magnetic and electronic types. There are two types of lamps, the four foot T8 (32 watt) and the four foot T12 (40 watt). Each of these require different ballasts. The T8 lamps have a reference current of 265 mA, while the T12 lamps have a reference current of 430 mA. The T8 lamps require a higher starting voltage and have a higher operating voltage as well.

Another very common type, especially with the widespread use of electronic ballasts with T8 lamps, is the parallel, instant-start, electronic ballast. This ballast type is commonly available in two, three, and four-lamp types.

Electronic ballasts have two common types of lamp drive circuitry, the commonly-called "voltage-fed series resonant" (VFSR) type and the commonly-called "current-fed parallel resonant" (CFCR) type. The VFSR circuitry is often employed with rapid-start ballasts and the CFCR is often employed with instant-start ballasts, although the reverse combinations are also found.

In general, compact and circline lamps do not have an operating current and/or voltage that matches well with the above discussed common inexpensive ballast types. Often, the common ballasts will provide too much current for higher power compact or circline lamps, especially if a two-lamp ballast is used to operate a single lamp. Even if the current is close enough, the voltage across the output of a rapid-start VFSR type may be too low to allow proper operating filament voltage.

Previously, multi-way switching and/or dimmability has been achieved by different methods. For example, U.S. Pat. Nos. 4,414,489 and 5,424,610, describes two separate one-lamp ballasts with switching of AC power to none, one or both. While the switch is simple, the two separate ballasts are extremely expensive, occupy too much space, and have half the reliability of a two-lamp ballast. Moreover, two-lamp dimming ballasts as described in U.S. Pat. Nos. 5,315,214; 5,099,176; 5,457,360; and 5,245,253 are available but are relatively expensive.

An inexpensive ballast configuration for switchably and, therefore, dimmably illuminating one or more higher power compact fluorescent lamps is desirable for the replacement of incandescent or halogen lamps. Moreover, were a compact or circline fluorescent configuration to easily fit in a lamp fixture designed for halogen lamps, specifically a fixture known as a torchiere, there would be a beneficial reduced need for the use of halogen lamps. Moreover, it would be beneficial to provide a multi-switching capability which itself, is simple, inexpensive and dissipates substantially no heat.

SUMMARY OF THE INVENTION

In a first embodiment, using a single ballast which is commonly used with linear fluorescent lamps, electrical connections are provided to two or more gas discharge lamps, such as compact fluorescent lamps. A capacitor is either in series or in parallel with at least one of the compact fluorescent lamps. When the parallel capacitor is engaged by a switch, it shunts current from the power source away from a first lamp. In this manner a first fluorescent lamp does not operate, but a second lamp does operate. When the capacitor is disengaged, current flows to the first lamp so that it too operates. When a capacitor is in series with at least one of the compact fluorescent lamps, and is engaged by a switch, it reduces the current from the power source to a first lamp in a manner which dims the first lamp.

In a second embodiment, using a single ballast which is commonly used with linear fluorescent lamps, electrical connections are provided to a single compact fluorescent lamp. A capacitor, in series with the lamp, when engaged by a switch reduces current to the lamp. In this manner, the current to the compact fluorescent lamp may be reduced, making it dimmable. Also, depending on the ballast, a capacitor can be switched in parallel with the lamp to reduce the current, operating the lamp so as to produce less light.

The type of internal ballast circuitry, either VFSR or CFCR, will usually dictate whether an external parallel or series capacitor(s) will be best for the various implementations of this invention. Generally, parallel capacitors are best suited for VFSR and magnetic ballasts, while series capacitors are best for CFCR ballasts.

DETAILED DESCRIPTION OF THE INVENTION

As discussed above, common ballasts for use with linear fluorescent lamps are often considerably less expensive than many types of ballasts designed for use with 18 watt and higher compact or circline fluorescent lamps. Ballasts for use with linear fluorescent lamps (hereinafter also referred to as "subject ballasts") may either be electronic or magnetic. Such electronic ballasts (such as for a T8) include rapid-start ballasts and instant-start ballasts. Different circuit configurations will be discussed below with respect to these two types of ballasts. Other types of subject ballasts, such as Pre-heat ballasts, may also be used and are within the scope of this invention.

Generally, in a first embodiment, this invention includes providing electrical connections between a subject ballast and at least two relatively high power compact fluorescent lamps. With a rapid-start ballast, the compact fluorescent lamps are arranged in series. With an instant-start ballast, the compact fluorescent lamps are arranged in a parallel configuration. As examples, different arrangements which provide various desirable features will be discussed with respect to the figures below. A second embodiment provides electrical connections between a subject ballast and a single compact fluorescent lamp.

As discussed above, the subject ballast operates at an output current which does not meet the requirements of compact fluorescent lamps. But advantageously, the circuit configuration of this invention adjusts the current to the compact fluorescent lamps in a manner which makes their operation compatible with the subject ballast, thus finally affording an economical arrangement.

According to the first embodiment of this invention, for switchability, using a capacitor to shunt current flow around a first compact fluorescent lamp can enable the second compact fluorescent lamp to operate at approximately the appropriate current. In such a 50% illumination state, while there is current through the capacitor, the voltage is not enough to cause the lamp to ignite. The first lamp does not operate because a compact fluorescent lamp requires a very high voltage (typically 250 V to 300 V) to ignite the gas which is avoided by the shunting capacitor. Accordingly, the current to the second compact fluorescent lamp can be approximately the appropriate current, based on the capacitor value. For a 100% light level, where the capacitor has been disengaged, the first compact fluorescent lamp is ignited. After ignition, the lamp operates at a much lower voltage.

Figures 1, 2:
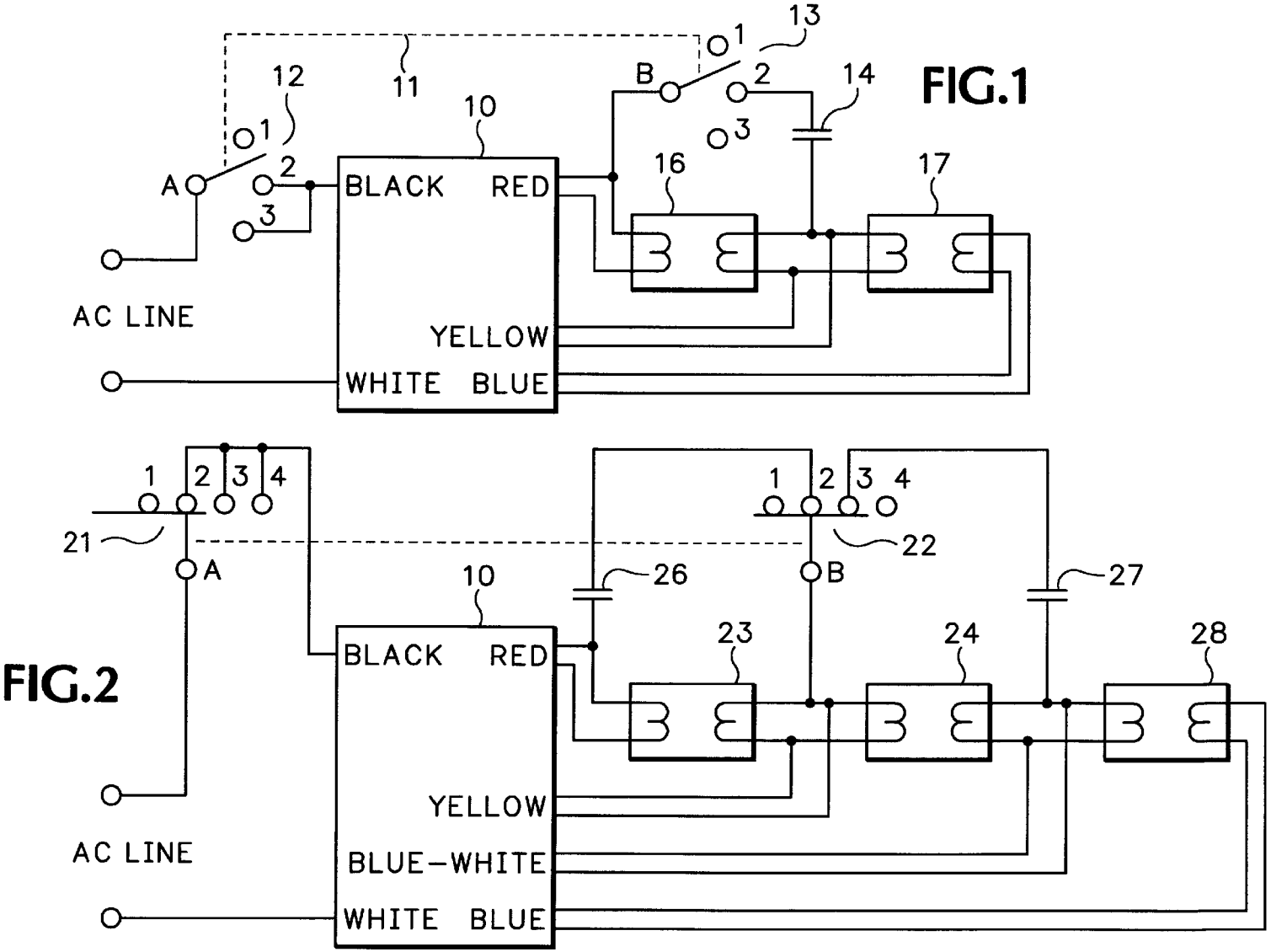
FIG. 1 is a circuit diagram of a two-lamp, series operation rapid-start arrangement of this invention.
FIG. 2 is a diagram of a three-lamp, series operation rapid-start ballast arrangement.

Referring to FIG. 1, a circuit diagram shows a two-lamp, series operation rapid-start ballast invention with one or more capacitors in parallel with a lamp, that can be switched to shunt a first lamp. Commonly used colored wires are used to illustrate the circuit arrangement. For virtually all U.S. ballasts, the Black lead is AC "Hot," White is AC Neutral, the Red pair is the highest voltage end of the series lamps, the Yellow pair connects to the midpoints of the series lamps, and the Blue pair connects to the remaining lamp ends. Such a configuration is preferable over the instant-start configurations discussed below because the level of filament heating provides a longer lamp life, especially when the lamp is operating at a reduced current, i.e. at 50%. Moreover, the voltage that the capacitors must withstand is lower. Also, rapid-start ballasts are the most common and thus the least expensive.

The subject ballast 10 is connected to switch 12 and switch 13. Switch 12 provides connection to the AC power (line voltage) and is "ganged" to switch 13 as shown by the dotted line 11. Both switches 12 and 13 are shown in the number 1 position, which is in the "OFF" position. The number 2 position applies power to the subject ballast, and connects the capacitor 14 across a Red lead and a Yellow lead, effectively shunting the first compact fluorescent lamp 16 providing the 50% illumination state. In position 3, the "FULL LIGHT" position, AC power is applied, but the capacitor 14 is no longer shunting the lamp. Thus, both lamps operate providing 100% illumination. If necessary, a smaller value additional capacitor can shunt both lamps to reduce the current in the lamps.

Capacitor 14 can be of any appropriate type, including capacitors where the dielectric is polyester, polycarbonate, polypropylene (preferred), ceramic, paper or polyphenylene-sulfide. Both metallized and film-foil types would operate sufficiently. Moreover, both dry and oil-filled capacitors would satisfy the requirements of operation of this invention. Certain ceramic and mica capacitors could also be used.

The coupled switches 12 and 13 may operate in a number of different manners depending upon the desired features of a product embodying this invention. For a particular desired lamp ignition condition, the switch to engage the capacitor may be delayed until after the corresponding lamp is operating, so that the lamp is dimmed upon engagement. Alternatively, ignition may be avoided by switch synchronization, ignition occurring at a different switch setting. Variations on the switching such as "make" and "break" timing, mechanical arrangements, and delayed timing of one or more switches are possible. Also, the switches may be mechanical or electronic switches and relays.

A capacitor's rating is chosen so that there is an appropriate amount of series reactance across the first (shunted) lamp which is in series with the second (operated) lamp such that the single operating lamp operates at the right current. For the configuration shown in FIG. 1, an adequate capacitor would be, for example, one of 0.022 $\mu$F. Dimmability is provided by the choice of capacitors and switching arrangement. Incremental dimmability of a single lamp requires capacitors of different values to be switched in the circuit for different desired illumination levels.

Just a switch arrangement across the lamp (without an appropriately chosen capacitor) would not provide the required current, generally operating the second lamp at too much current. Furthermore, the voltage across the Red to Blue leads of a series rapid-start ballast would be lower than normal, giving the wrong filament voltage to the operating lamp. This lower than normal Red to Blue voltage could result in overheating the particular ballast, creating a reliability problem.

Referring to FIG. 2, a four-way switching system including three lamps is shown. Switch 21 is in communication with switch 22 in a ganged arrangement or otherwise useful configuration. The four-way switching allows two lamps 23 and 24 to be shunted by capacitors 26 and 27 for ⅓ LIGHT by lamp 28. One lamp 23 may be shunted by capacitor 26 for ⅔ LIGHT by lamps 28 and 24. Moreover, no lamps will be shunted for FULL LIGHT when switch 21 and therefore switch 22 is in the OFF position.

A variation of the systems shown in FIGS. 1 and 2 is the use of parallel capacitors to reduce the arc current of on and/or both lamps which allows the use of a ballast to operate one or more lamp(s) at somewhat less than full-rated ballast output current. The arrangements are similar to FIGS. 1 and 2, but the switched parallel capacitors(s) will have a higher reactance (smaller value) to allow the lamp(s) to light, albeit at a lower current. Also, a single, small value can shunt all lamps to reduce the current in the lamps.

Figure 3A:
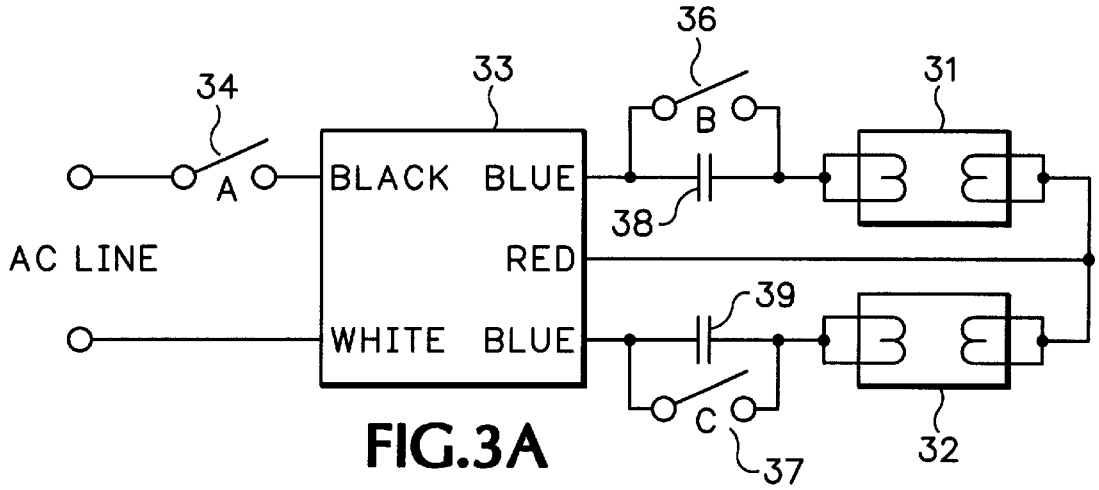
FIG. 3A is a diagram of a two-lamp, parallel operation instant start ballast arrangement.

Referring to FIG. 3A, switched series capacitors for lamps used with instant-start, parallel operation ballasts are shown. In such an arrangement, when a series capacitor is switched in the circuit, that lamp lights, but at a reduced power. In situations where the subject ballast is rated for higher arc current than the lamps being used, such an arrangement is used to reduce the full-power lamp currents from the subject ballast. Additionally, other, non-switched capacitor((s) can be used to reduce the current.

FIG. 3A shows a configuration with two lamps 31 and 32, instant-start ballast 33, and with three switches 34, 36 and 37. Switch 34 is for switching power, and switch 36 is for switching capacitor 38 and switch 37 is for switching capacitor 39. As discussed above, the timing of the switches is dependent upon the features desired in a product embodying this invention. The capacitors' values may be chosen to have the same or different values and more than one capacitor may be in series with a particular lamp, such capacitors being switched in or out of the circuit.

Figure 3B:
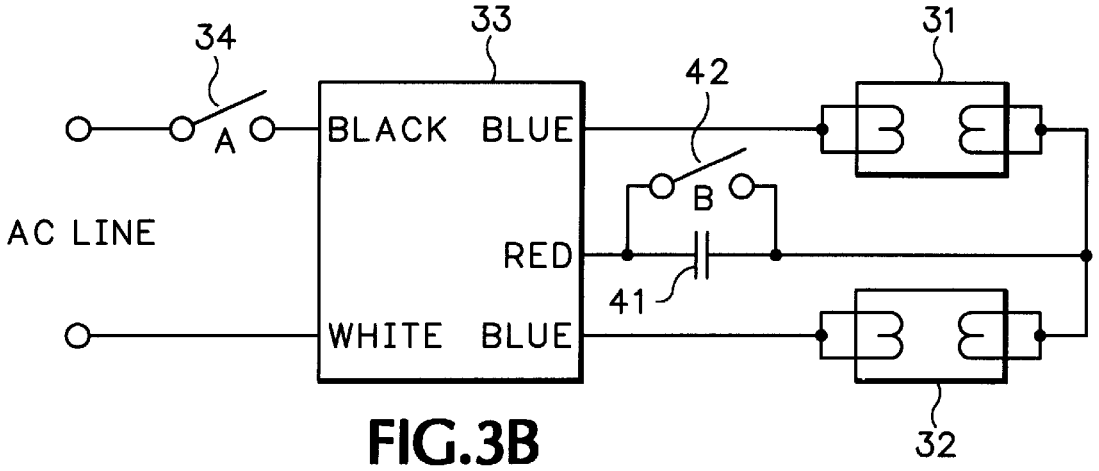
FIG. 3B is a diagram of two-lamp, parallel operation instant start ballast arrangement.

Referring to FIG. 3B, yet another configuration is shown. Here, a single capacitor 41 when switched in the circuit by switch 42 will dim both lamps. All combinations of switching and capacitors in series and in parallel with all types of gas discharge lamps are within the scope of this invention.

Figure 4:
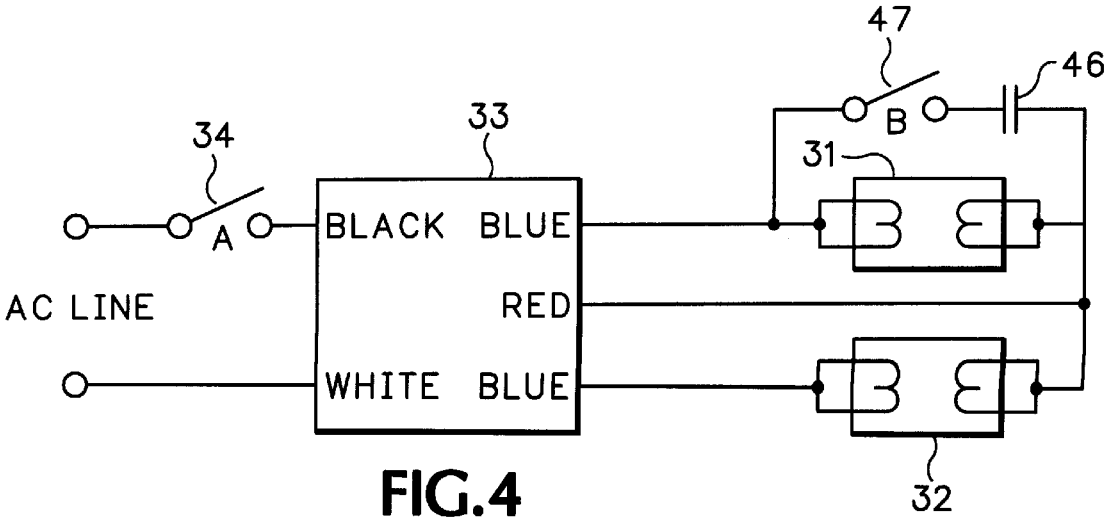
FIG. 4 is a diagram where a capacitor is parallel to a compact fluorescent lamp.

For instant-start ballasts, parallel capacitors can be used alone or with series capacitors to tailor the arc current for one or more lamps, depending on the switching used. Referring to FIG. 4, a parallel capacitor 46 may be switched in the circuit by switch 37 to reduce the light output from one lamp 31.

Figure 5A:
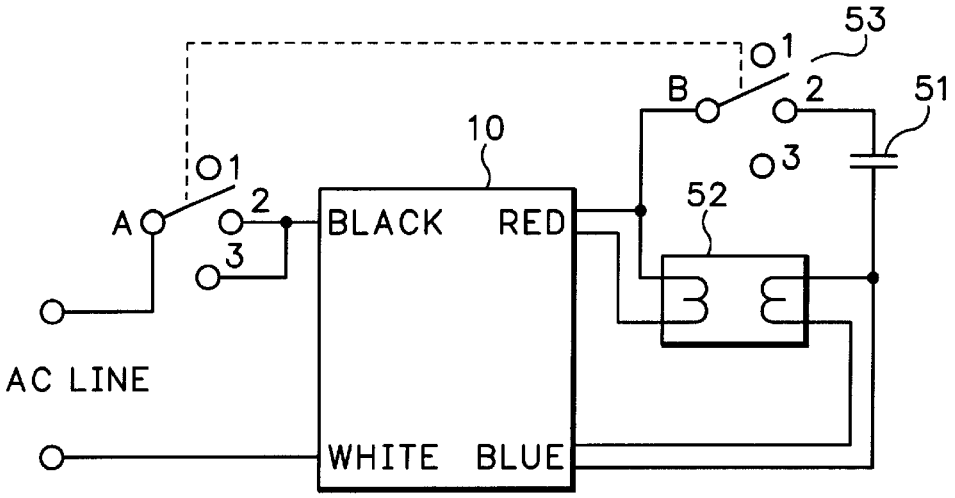
FIG. 5A shows a capacitor parallel to a single compact fluorescent lamp.
Figure 5B:
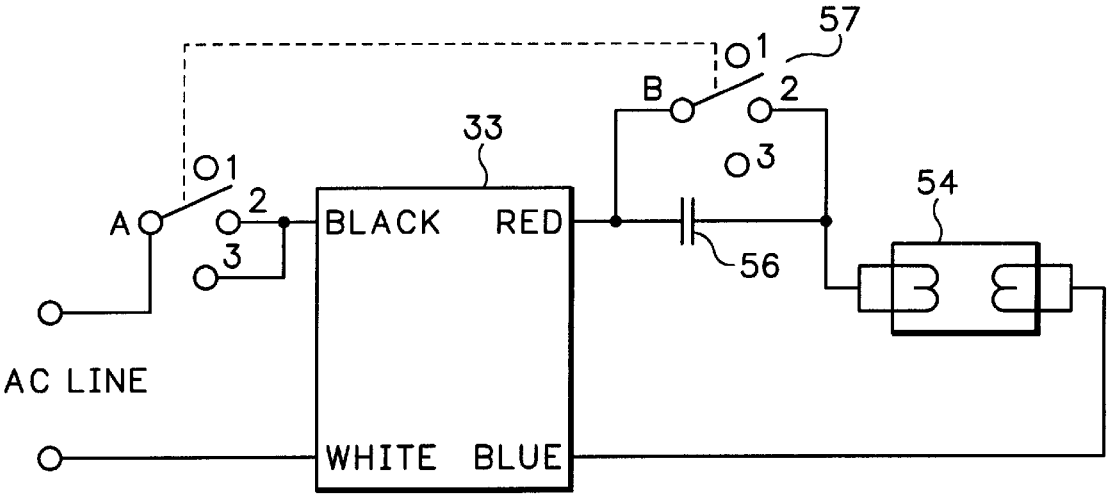
FIG. 5B shows a capacitor in series with a single compact fluorescent lamp.

Referring to FIG. 5A, the above mentioned second embodiment is shown in a diagram which depicts a capacitor 51 parallel to a single compact fluorescent lamp 52 using a rapid-start ballast 10. The ballast could be a one-linear-lamp or two-linear-lamp ballast (with extra lamp leads not connected). The switch 53 is similar to that of FIG. 1 and is in the position is "off." Position 2 is for reduced light, and position 3 is for full light. On the other hand, FIG. SB is a diagram of a one-lamp arrangement of this invention, using an instant-start ballast 33 for operating lamp 54 for one or more linear lamps (any extra leads are not connected). The capacitor 56 is in series with lamp 54 and is engaged when switch 57 is in an "on" position, either 2 or 3.

Figure 6A:
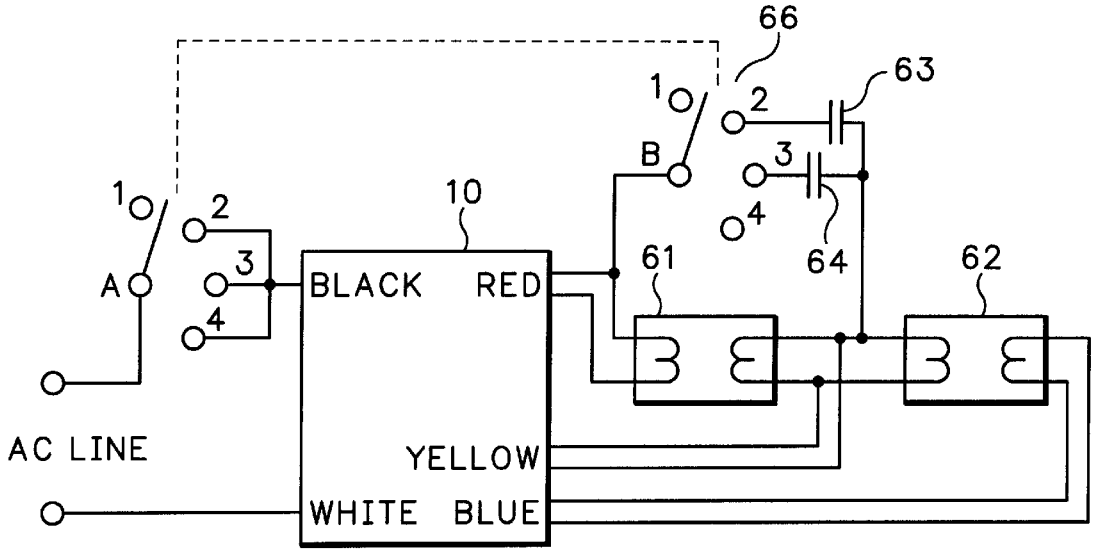
FIG. 6A is a diagram of a two-lamp configuration having one lamp in parallel with two capacitors.
Figure 6B:
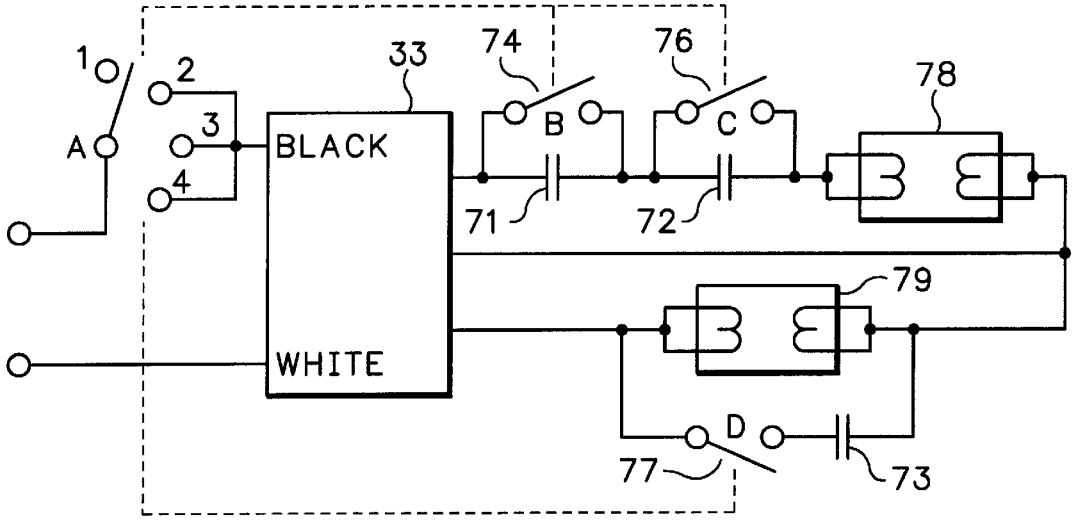
FIG. 6B is a diagram of a two-lamp configuration with a combination of series and parallel capacitors.

Finally, referring to FIGS. 6A and 6B, arrangements are shown with two gas discharge lamps as used with this invention (any number of gas discharge lamps may be used, of course). FIG. 6A shows a rapid-start ballast 10 connected to two lamps 61 and 62, one of which, 61, is in parallel with two capacitors 63 and 64. In this arrangement, switch 66 is equipped with four settings, such providing a plurality of dimming levels for lamp 61. FIG. 6B shows an instant-start ballast 33 with a combination of series and parallel capacitors, 71, 72 and 73, respectively in communication with switches 74, 76, and 77 for operating lamps 78 and 79 with ballast 33.

In yet another embodiment, a single ballast is used for providing current to a gas discharge lamp for which it was intended, such as a T12 ballast connected to T12 lamps. Referring to FIGS. 1, 2 and 3A for example, the lamps shown may alternatively be lamps for which the ballast was intended. Just as described with reference to the two embodiments discussed in detail above, at least one gas discharge lamp is coupled to one or more capacitors in parallel or in series. In this manner a plurality of illumination levels is provided by the arrangement of this invention.

Accordingly, using a single ballast which is commonly used with linear fluorescent lamps one or more higher power compact fluorescent lamps may be operated by placement of an appropriately valued capacitor either in series or in parallel with at least one compact fluorescent lamp. Switchability and dimmability are provided when the capacitor is engaged by a switch, the capacitor shunting current from the ballast to a lamp (parallel) or by reducing current (series). In this manner, an inexpensive ballast, previously unusable with compact fluorescent lamps provides many desirable features.

We claim:

1. An arrangement, comprising:

a single non-inductive ballast for providing current from a power source to at least one gas discharge fluorescent lamp which is different than the lamp or lamps for which said single ballast is primarily intended, the single ballast being a readily commercially available, operating at a high frequency, and having at least an input side and an output side, the input side being coupled to the power source;

at least one capacitor coupled to the output side of the single ballast; and a switch coupled to said capacitor on the output side of the single ballast wherein when said capacitor is engaged by said switch, the capacitor changes the current that would otherwise be present in said gas discharge lamp in a manner that allows more than one illumination level of said gas discharge lamp.

2. An arrangement as recited in claim 1, wherein said capacitor is in parallel with said lamp.

3. An arrangement as recited in claim 2, wherein a second capacitor is in parallel with said lamp.

4. An arrangement as recited in claim 1, wherein said capacitor is in series with said lamp.

5. An arrangement as recited in claim 4, wherein a second capacitor is in series with said lamp.

6. An arrangement as recited in claim 1, wherein said at least one gas discharge lamp is two gas discharge lamps.

7. An arrangement as recited in claim 6 wherein said capacitor operates to reduce the current flow to a first of said two gas discharge lamps.

8. An arrangement as recited in claim 6 wherein said capacitor operates to avoid the current flow to a first of said two gas discharge lamps.

9. An arrangement as recited in claim 1, wherein said at least one gas discharge lamp is three gas discharge lamps.

10. An arrangement as recited in claim 1 wherein said gas discharge lamp is a compact fluorescent lamp.

11. An arrangement as recited in claim 1 wherein said gas discharge lamp is a circline fluorescent lamp.

12. An arrangement as recited in claim 1 wherein said ballast is a rapid-start ballast.

13. An arrangement as recited in claim 1 wherein said ballast is an instant-start ballast.

14. An arrangement as recited in claim 1 wherein said switch is in communication with a second switch.

15. An arrangement, comprising:

high frequency non-inductive type ballast means for altering current from a power source, the ballast means having an input side and an output side, the input being coupled to a power source;

capacitive means coupled to the output side of the ballast means and to at least one gas discharge lamp which is different than the lamp or lamps for which said ballast means is primarily intended;

switching means for engaging the capacitive means so that when engaged, said capacitive means changes the current that would otherwise be present in said gas discharge lamp in a manner which allows more than one illumination level of said gas discharge lamp.

16. An arrangement as recited in claim 15, wherein said at least one gas discharge lamp is two gas discharge lamps.

17. An arrangement as recited in claim 15 wherein said capacitor operates to reduce the current flow to a first of said two gas discharge lamps.

18. An arrangement as recited in claim 15 wherein said capacitor operates to avoid the current flow to a first of said two gas discharge lamps.

19. A method for providing an arrangement, comprising:

providing a single non-inductive type ballast having electrical connections for providing current from a power source to at least one gas discharge fluorescent lamp which is different than the lamp or lamps for which said single ballast is primarily intended;

providing that said connections be part of a circuit configuration having at least one capacitor coupled to an output side of the ballast;

providing a switch which is coupled to said capacitor wherein when said capacitor is engaged by said switch, the capacitor changing the current that would otherwise be present in said gas discharge lamp in a manner that allows more than one illumination level of said gas discharge lamp.

20. A method as recited in claim 19, further comprising the step of providing that said capacitor is in series with said lamp.

21. A method as recited in claim 19, further comprising the step of providing that said capacitor is in parallel with said lamp.

22. An arrangement, comprising:

a single non-inductive type ballast having electrical connections for providing current from a power source to at least one gas discharge fluorescent lamp, the ballast having an input side coupled to the power source and an output side coupled to the fluorescent lamp;

said connections being part of a circuit configuration having at least one capacitor, the capacitor being coupled to the output side of the ballast;

a switch coupled to said capacitor on the output side of the ballast wherein when said capacitor is engaged by said switch, the capacitor changes the current that would otherwise be present in said gas discharge lamp in a manner that allows more than one illumination level of said gas discharge lamp.

23. An arrangement as recited in claim 22, wherein said capacitor is in parallel with said lamp.

24. An arrangement as recited in claim 23, wherein a second capacitor is in parallel with said lamp.

25. An arrangement as recited in claim 22, wherein said capacitor is in series with said lamp.

26. An arrangement as recited in claim 25, wherein a second capacitor is in series with said lamp.

27. An arrangement as recited in claim 22, wherein said at least one gas discharge lamp is two gas discharge lamps.

* * * * *